US008041271B2

(12) United States Patent
Shanun et al.

(10) Patent No.: US 8,041,271 B2
(45) Date of Patent: Oct. 18, 2011

(54) LASER TONER CARTRIDGE TONER SCATTER PREVENTION SYSTEM AND PROCESS

(75) Inventors: Sagie Shanun, Sherman Oaks, CA (US); Or Fischer, Los Angeles, CA (US); Jesus Gonzales, Chatsworth, CA (US)

(73) Assignee: Wazana Brothers International, Inc, Van Nuys, CA (US)

( * ) Notice: Subject to any disclaimer, the term of this patent is extended or adjusted under 35 U.S.C. 154(b) by 580 days.

(21) Appl. No.: 12/046,326

(22) Filed: Mar. 11, 2008

(65) Prior Publication Data

US 2009/0232540 A1 Sep. 17, 2009

(51) Int. Cl.
*G03G 15/08* (2006.01)

(52) U.S. Cl. ..... 399/284; 399/274

(58) Field of Classification Search ..... 399/284, 399/274

See application file for complete search history.

(56) References Cited

U.S. PATENT DOCUMENTS

| | | | | |
|---|---|---|---|---|
| 5,576,813 | A * | 11/1996 | Toyama et al. | 399/274 |
| 5,581,336 | A | 12/1996 | Matsuzaki et al. | |
| 2001/0026705 | A1* | 10/2001 | Sato et al. | 399/98 |
| 2002/0197086 | A1* | 12/2002 | Ishibashi et al. | 399/272 |

FOREIGN PATENT DOCUMENTS

| | | | |
|---|---|---|---|
| JP | 59139065 | A | 8/1984 |
| JP | 61204657 | A | 9/1986 |

* cited by examiner

*Primary Examiner* — David Gray
*Assistant Examiner* — Roy Y Yi

(57) ABSTRACT

Systems and methods for preventing and/or inhibiting toner scatter inside of laser printer toner cartridges including a shield that is adjacent to the toner regulating member, extends over and adjacent the developing roller, includes triboelectric material of a polarity corresponding to the polarity of the laser printer cartridge during operation and that functions as a physical barrier and as an electrical barrier to direct toner particles that scatter away from the developer roller back toward the developer roller.

12 Claims, 8 Drawing Sheets

FIG. 3

Triboelectric Series

Asbestos — More Positive
Rabbit fur
Acetate
Glass
Mica
Human Hair
Nylon
Wool
Fur
Lead
Silk
Aluminum
Paper
Cotton
Steel
Wood
---------- Neutral
Amber
Sealing Wax
Hard Rubber
Mylar
Nickel
Copper
Silver
UV Resist
Brass, SS
Gold, Platinum
Sulfur
Acetate Rayon
Celluloid
Orlon
Acrylic
SRAN
Polyurethane
Polyethylene
Rubber Ballon
PVC (Vinyl)
Silicon
Teflon
Silicone Rubber — More Negative

LASER TONER CARTRIDGE TONER SCATTER PREVENTION SYSTEM AND PROCESS

FIELD OF INVENTION

The present system and process relates to the field of laser toner cartridges, specifically to preventing toner scatter in the developing section of a laser toner printer cartridge.

BACKGROUND OF INVENTION

Electro photo printing technology is an evolving technology that changes with time as market demands, especially the computer market and the imaging market, evolve and change. The main features of the printer/cartridge technology that are presently evolving include:

A. Printer Speed

As time passes printer manufacturing firms try to design faster printing machines. The speed of a printing machine is usually defined by the number of pages the printer can print per minute (also known as ppm). In today's market, there are office laser printers that can go up to 60 pages per minute.

B. Print Resolution

As the imaging market evolves more and more customers expect higher print quality. Where in the past, laser printers used to print simple graphics, in today's market the printers can print in relatively high resolutions, around 1200 dots per inch (dpi).

C. Demand for Color

The laser toner color printer market share is growing every year relative to that of the black and white laser toner printer market.

In order to accommodate for the market's demands, new toner formulations and toner making technologies have been developed to comply with the evolving demands for speed, resolution and use of colors. Higher printing speed printers require toner resins with lower melting points to accommodate for the faster fusing speed. Higher resolution printers require smaller average particle size toner in order to achieve the small details in high resolution images and color toners inhibit the use of magnetic toner system. Hence, most color toners are mono-component, non-magnetic toners. Moreover, the need for color, non-magnetic toner significantly limits the variety of materials that can be used as resins. Those changes and others known in this field but not specifically described herein are responsible for a number of side effects in the functionality of toner cartridges such that they create print defects and reduce print quality. The present system and method are directed to solving a common problem found in high speed, non-magnetic toner printer systems and color toner systems. This problem is usually called "toner scatter" or "dusting". Toner scatter refers to toner particles that disengage from the developing system and accumulate inside of the laser toner cartridge, and typically create local print defects on the printed media, such as toner stains or continuous haze. Continuous haze is also known as "background" on the printed media.

In one preferred embodiment of the present system and method a toner shield is installed inside of the laser toner cartridge in order to prevent the toner scatter phenomenon. When installed the toner shield minimizes or prevents toner from scattering and/or accumulating inside of the cartridge, thus eliminating the aforementioned print defects. The shield described below can be used in a new laser toner cartridge or in a remanufactured laser toner cartridge.

SUMMARY

The toner shield system and method described herein overcomes the drawbacks of known toner scatter phenomena by providing physical and electrical shields that prevent and/or inhibit accumulation of toner in unwanted areas inside the toner cartridge and force the scattered toner back to its original course toward the developer roller, thus preventing or minimizing print defects or problems caused by scattered toner.

The present system and method relates, for the most part, to a single component, non magnetic toner system. In the case of a non-magnetic toner system, a relatively soft developing roller is used. The roller is generally made of polyurethane and includes a regulating member made of polyurethane or a metal. The regulating member is often referred to in this field as a "doctor bar". In some laser printer systems the regulating member is made in the shape of a rigid metallic rod.

As is well known the toner particles are in a size distribution, with some particles of relatively small size, some of relatively large size and some of intermediate size. It is believed that high printing speed and use of non-magnetic toner causes smaller and larger particles within the toner particle size distribution to disengage from the developing roller and accumulate primarily on top of the regulating member. This toner accumulation is believed to create or lead to various defects or problems, such as hazing, local staining of the printed media and/or dusting inside of the printer. This scattered toner can contaminate printer and cartridge components such as the transfer belt, pick-up rollers, fuser rollers and so forth.

By installing a shield on the top of the regulating member, the scattering and accumulation of the toner is prevented, inhibited and/or minimized. The preferred shield includes a film of double sided adhesive and a generally L-shaped, angled strip of insulating material having a high triboelectric value of the same polarity as the triboelectric value of the toner. Scattering and accumulation of the toner is prevented or minimized and as a result the related defects are prevented or minimized. The preferred shield functions as a physical barrier as well as an electrical barrier to flow of scattered toner to unwanted areas within the toner cartridge. The preferred shield creates a static electrical field with the same polarity as the charged toner, and thus repels the scattered toner particles, forcing them back to the developing roller.

BRIEF DESCRIPTION OF THE DRAWINGS

FIG. 3 is a chart presenting a list of different materials and their relative triboelectric charge values.

DETAILED DESCRIPTION

Figure 1:
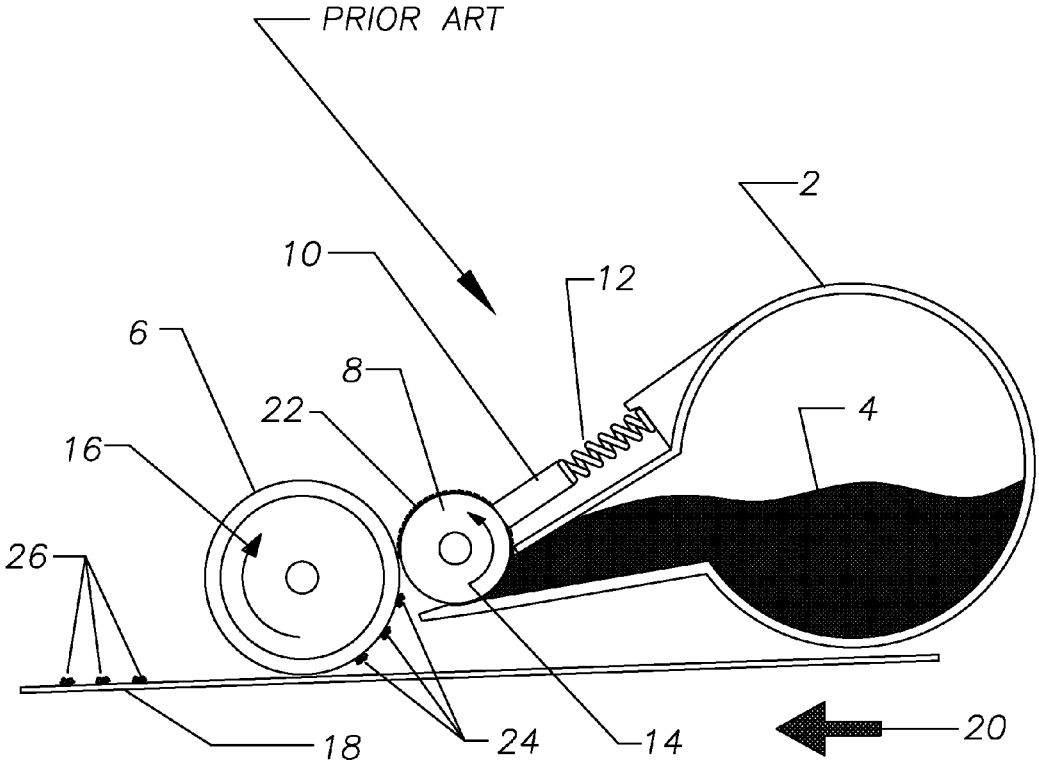
FIG. 1 is a cross sectional view of a prior art laser toner cartridge developing section.

FIG. 1 shows a partial side view of a typical prior art laser toner cartridge development or developer section. The prior art laser toner cartridge contains a toner container 2 also known as "toner hopper", toner powder 4, photo-sensitive member 6, developing roller 8, regulating member 10, a spring 12 that creates tension between the regulating member 10 and the developing roller 8, the printing medium 18. As the developing roller 8 rotates in the direction of the arrow 14, it transfers toner 4 from the toner hopper 2 onto its surface 22. As the toner at surface 22 passes through the narrow space, known in this field as a "nip", between the developing roller and the regulating member 10 it acquires an electrical charge. The photo-sensitive member 6 rotates in the direction of the arrow 16, and the toner is transferred only onto the areas were the laser formed the latent image over the surface of the photo-sensitive member at 24. The toner at 24 is then transferred from the surface of the photo-sensitive member 6 onto the printing medium 18 as the printing medium moves in the direction of arrow 20. The toner creates the image 26 on the printing medium.

Figure 2:
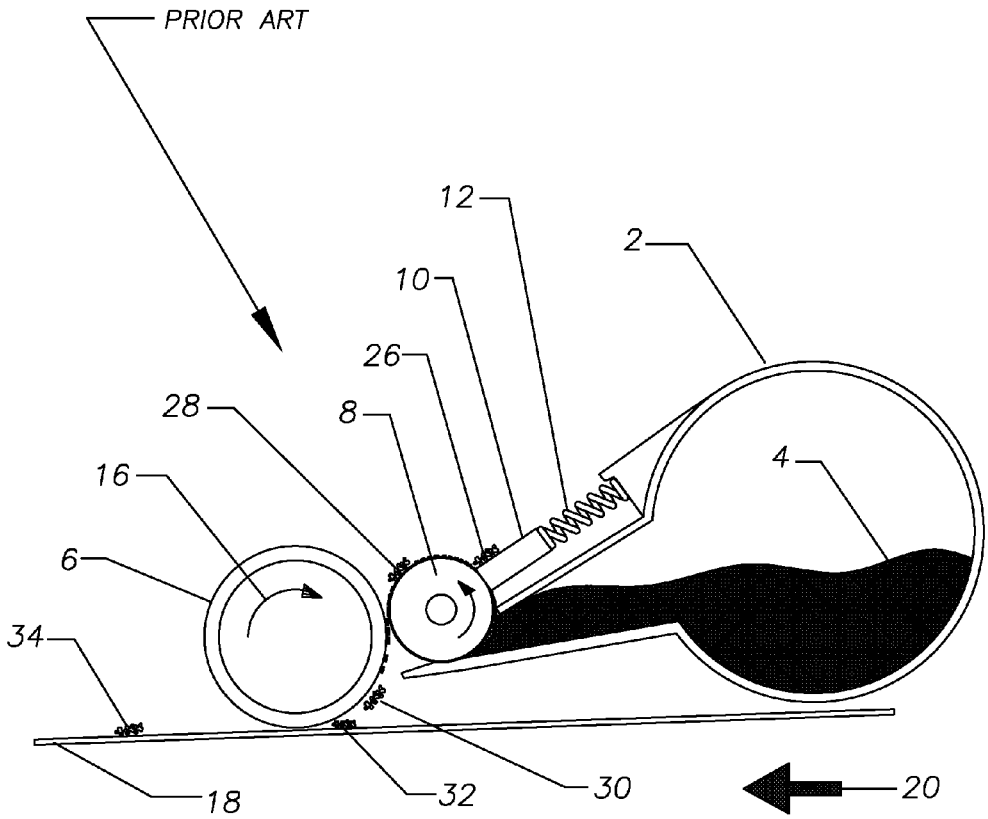
FIG. 2 is cross sectional view of the prior art laser toner cartridge of FIG. 1 illustrating the toner scatter phenomenon.

Referring to FIG. 2, the toner scatter phenomenon is described. It is believed that as a result of the high rotational speed of the developing roller, some of the bigger or smaller toner particles have a high enough momentum to leave the surface of the developing roller 8 and accumulate on the surface of the regulating member 26. It is also believed that small particle size toner powder cannot acquire sufficient electrical charge to keep them temporarily attached to the developing roller as it turns. As a result, those small size particles also accumulate over the surface of the regulating member 26. Once the mass of the accumulated toner particles 26 is high enough, a portion of these particles 28 will fall onto the surface of the developing roller 8. That portion of toner in turn will be transferred to the surface of the photo-sensitive member at 30, and in turn fall directly onto the printing medium at 32, or will turn with the photo-sensitive member and will be transferred to the printing medium, shown for example at 34. Moreover, it is believed that some smaller toner particles from the toner accumulating on the regulating member 26 continuously disconnect from the toner accumulation at 26 and fall onto the developing roller, thus creating heavy hazing (background) on the printing media.

Referring to FIG. 3, examples of different materials with their relative triboelectric values are shown. Within the context of the present system and method the term triboelectric is used synonymously with the terms triboelectric effect and triboelectric charging, and means a type of contact electrification in which certain materials become electrically charged when they come into contact with another, different material, and are then separated, such as through rubbing or become electrically charged when they come into static contact with some other material that is electrically charged or biased and the charged is transferred to the triboelectric material. The polarity and strength of the charges produced differ according to the materials, surface roughness, temperature, strain and other properties.

It can be observed from the FIG. 3 listing of materials that in order to create an effective electrical shield, an insulating material with a negative triboelectric value has to be chosen for a negative toner system. In the context of the present system and method a negative toner system is a cartridge system that generates negative charge on the toner. Similarly, an insulative positive triboelectric value material has to be chosen for a positive toner system. From FIG. 3, PVC and polyethylene are good candidates for a negative toner system. It is believed that derivatives of polyethylene, such as polyethylene terephtalate (PET), for example, are also good candidates for a negative toner system. Also, acetate is a good example for a shield made for a positive toner system. With respect to usefulness as a shield, silicon and Teflon (fluorocarbons) are more negative than PVC (polyvinyl chloride), for example, but are harder to manage and less useful due to their mechanical properties, especially their stiffness, low adherence and their relative higher cost. With respect to positive toner system materials, such as glass, mica and asbestos, they are relatively less useful due to their hardness, which makes manufacturing shields to the required dimensions difficult. Also, these materials lack the physical stiffness and flexibility of the acetate polymer, another material listed on FIG. 3 that is in the "more positive" category.

Figure 4:
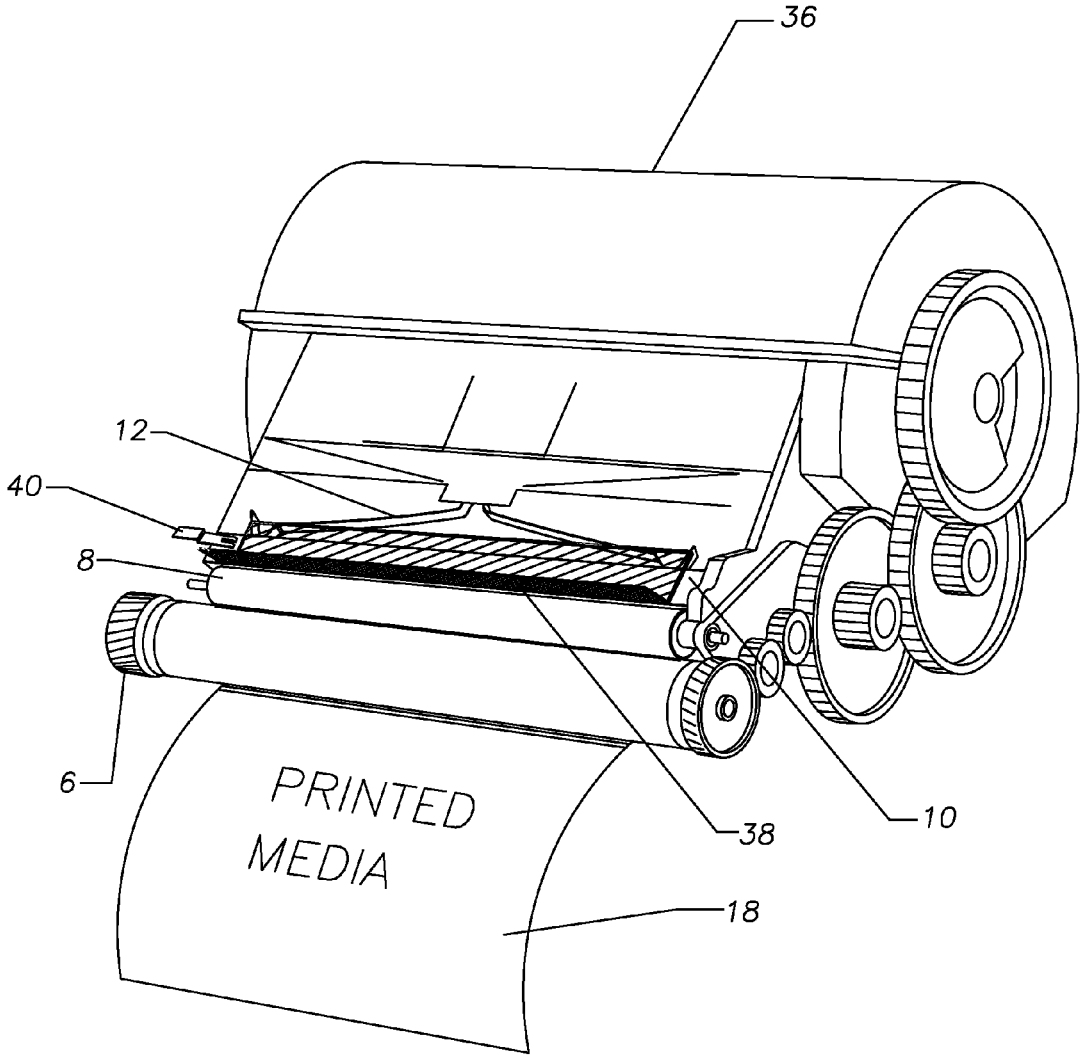
FIG. 4 is a perspective view illustrating the position of a preferred embodiment shield inside of the toner hopper.

Referring to FIG. 4, a perspective view of the location of a preferred embodiment toner shield system is described. The shield shown in FIG. 4 is intended for a particular toner cartridge. As will be appreciated by those skilled in this field, the structural details and configuration of toner shields of the present system and method will vary according the specific structure of the toner cartridge to which they will be coupled, and a wide variety of toner cartridge structures are known and commercially available. Also, while the FIG. 4 embodiment shows a preferred shield to be adhered to the toner regulating member of a cartridge, a shield that functions to inhibit and/or prevent toner scatter may be placed at other locations within the printer. Thus, virtually any configuration and/or location of a toner shield is considered to be within the scope of the present system and method so long as it performs either or both function(s) of a physical barrier to toner scatter and/or an electrical barrier to toner scatter. Toner hopper 36, a photo-sensitive member 6, a developing roller 8, a regulating member 10, a tension leaf spring 12, the printing medium 18 and the toner shield 38 are shown in FIG. 4. With respect to the toner cartridge shown in FIG. 4, the shield 38 is preferably located on the surface of the regulating member 10. In the most preferred embodiment, as illustrated in FIG. 4, the toner shield 38 is spaced at about 0.005-0.5 inches from the bottom edge of the regulating member 10. The included angle between the legs of the preferred angled toner shield preferably is in the range of about 70-130 degrees, as shown in greater detail in FIG. 5. The shield 38 does not touch the developing roller 8. The shield 38 also functions to prevent the leaf spring 12 from disengaging as a result of vibration or impact. The shield 38 is preferably connected or fastened to the regulating member 10 with a double-sided, adhesive tape such as 3M 9495LE tape. As will be appreciated by those skilled in this field, other brands of tape, and other ways of positioning or attaching the shield to the toner cartridge may used without departing from the principles and functioning of the present system and method.

Figure 5:
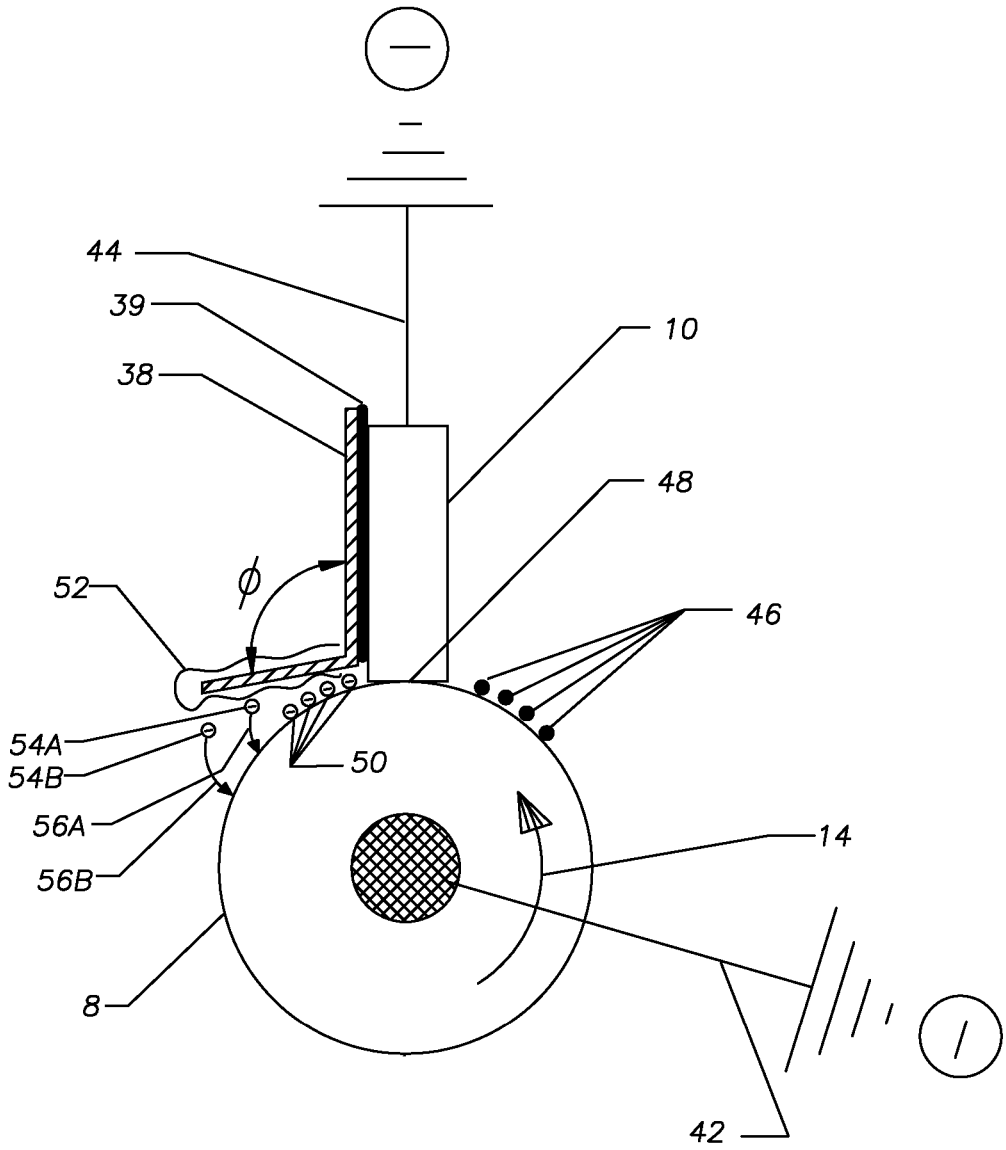
FIG. 5 is a cross sectional view of the FIG. 4 preferred shield embodiment that prevents toner from accumulating in the developing section of the cartridge.

Referring to FIG. 5, the shielding effect of the toner shield and the prevention of toner accumulation by the toner shield will be described. The preferred shield has the general shape of an L, with an angle Φ included between the first leg and second leg, as shown in FIG. 5. The preferred angle Φ is 70 to 130 degrees. The developing roller 8 turns in the direction of the arrow 14 against the regulating member 10. In case of a negative toner system, the developer roller 8 and the regulating member 10 are electrically connected to a conventional, negative bias 42, 44 respectively, so that a negative electrical charge is transferred to the surface of the shield. In this example the electrical shielding effect is shown with a negative toner system. The electrical bias on the developing member and on the regulating member creates a negative electrical field on their surface by induction. The toner 46 passes through the contact area 48, also called the nip, and acquires a charge 50 of the same polarity of the bias 42 and 44. As a result of the bias on the regulating member 10, the toner shield 38 when connected to the regulating member with a double coated adhesive 39 develops a negative electrostatic field by induction, in a similar way an electrostatic field develops on a dielectric material inside of a capacitor when the capacitor is charged. The current applied on the regulating member generates an electrical field perpendicular to the face of the regulating member and that in turn induces an electrostatic field on the surface of the toner shield at 52. It is believed that the magnitude of the electrostatic field developed in a direction perpendicular or orthogonal to the surface of the shield face, thus the effectiveness of the toner shield electrical barrier, depends on several factors. For example, the ability of the dielectric material, hence the toner shield to retain electrostatic charge on its surface is believed to be an important factor relating to shield effectiveness. Also, the dielectric constant of the polymer the shield is made of, the magnitude of the bias, the thickness of the shield, the thickness of the double-sided tape and the shape of the regulating member and the shape of the shield are all believed to be factors that play a role in shield effectiveness. Thus, it is believed that scattered toner particles 54 having the same polarity as the electrical field at 52, encounter a physical barrier, i.e., the shield, as well as an electro-static barrier field at 52 due to the same polarity of the toner particles and the surface 52. As a result the electrical forces cause the scattered particles 54A and 54B to be directed back onto the developing member 8 in the direction of the arrows 56A and 56B, thus preventing accumulation of the scattered particles 54A and 54B on unwanted areas inside the cartridge. In a positive toner system the biases 42, 44 will be positive and the electrical field 52 will be positive and the toner particles 50, 54A and 54B will be positive as well.

Figure 6:
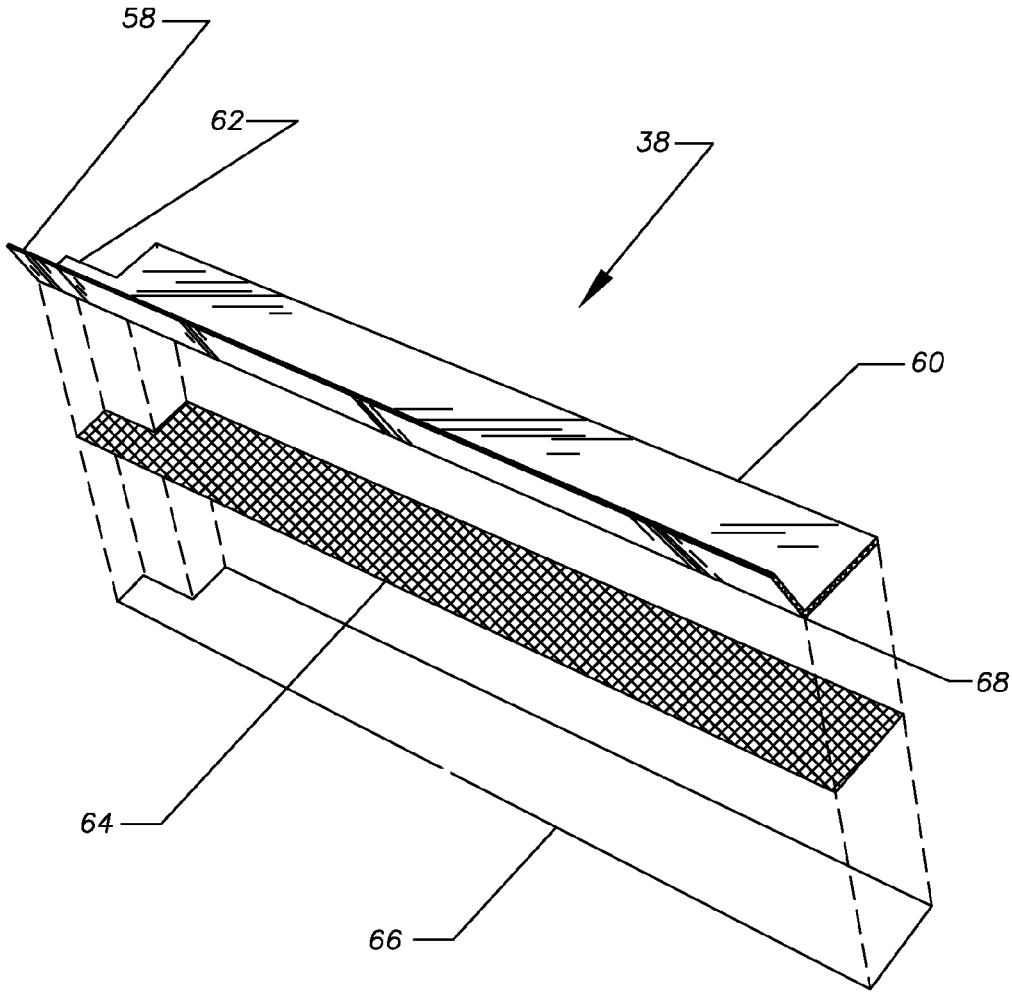
FIG. 6 is an exploded perspective view of the preferred toner shield of FIG. 4.

Referring to FIG. 6, the toner shield 38 includes shield face 58 and a regulating member face 60 that adheres to the surface of the regulating member preferably by adhesion with two-sided tape 64. The two-sided tape 64 can be either insulated or conductive and, as referred to above the shielding effect depends on various factors such as the material and structure of the toner shield 38. The shield 38 also preferably includes a notch 62 to accommodate the regulating member contact. The regulating member contact transfers the electrical bias, shown at 44 in FIG. 5 to the regulating member, thus charging the regulating member, double-coated adhesive tape 64 and release film 66. The two-sided tape and the release film are conventional and commercially available. During the process of application of the shield to the regulating member, the release paper is pealed off and the toner shield is placed in position using a positioning spacer tool, shown in FIG. 8, in order to assure the correct distance from the shield face 58 to the developing roller. The spacer tool is preferably a conventional, commercially available shim made of a soft flexible polymer in order to avoid damaging the developing roller during installation. A few examples for the spacer are polypropylene, polyethylene, PVC and acetate.

Figure 7:
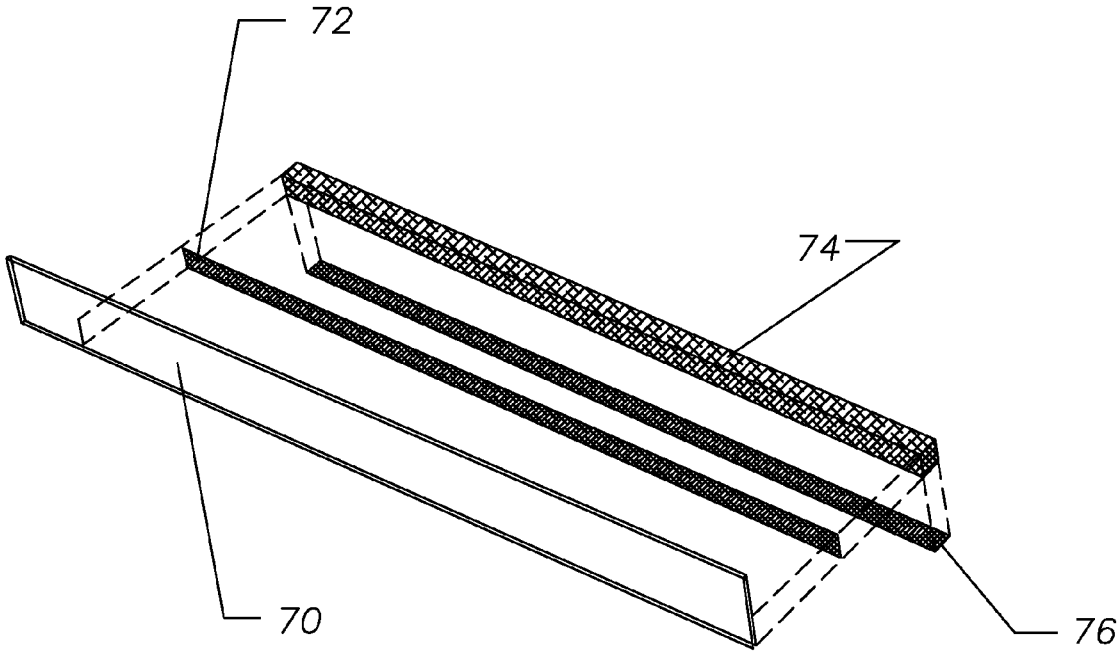
FIG. 7 is an exploded perspective view of the shield of FIG. 4 shown attached by an alternative method to the regulating member.

Referring to FIG. 7, an alternate preferred embodiment toner shield is shown. Instead of having one sheet of insulative material the toner shield 70 includes an insulative flat sheet 70. The sheet 70 is made of a material with a high triboelectric value corresponding to the polarity of the bias. The shield 70 also includes a double or two-sided adhesive tape 72. The preferred tape is 3M 9495E, but other tapes can be used so long as they function for its intended purpose. The shield 70 also includes a rod 74, shown in FIG. 7 as having a rectangular configuration. The rod 70 can be a rectangular rod, an angled rod or have an angled profile. A two-sided adhesive or double adhesive tape 76 connects the rod 74 to the regulating member. The rod 74 can be made of many types of material, electrically conductive or insulated, so long as it is structurally capable of functioning for its intended purpose of being a component of the toner shield. The tapes 72 and 76 can be any type of commonly used double sided adhesive tape, such as 3M 9495LE, which is preferred.

Figure 8:
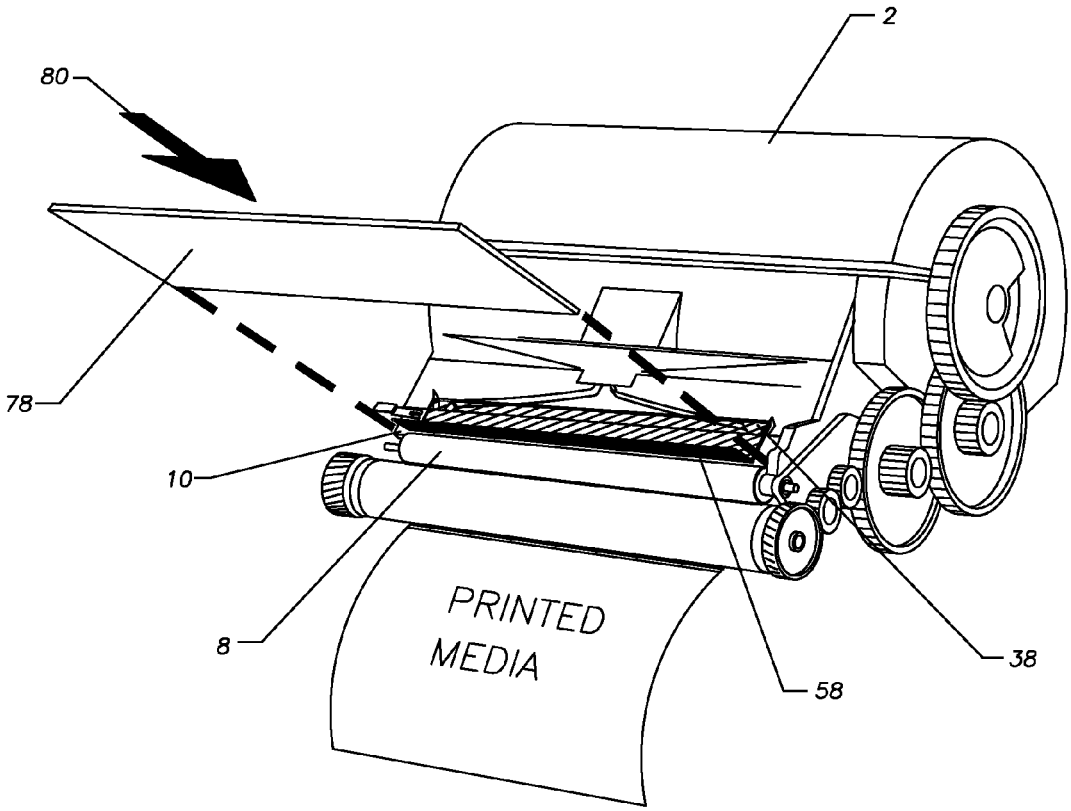
FIG. 8 is a perspective view showing installation of the preferred shield of FIG. 4 with a preferred tool.

Referring to FIG. 8, the preferred method of installation of the toner shield on the regulating member is described, using a conventional, commercially available shim stock 78. The shim stock is preferably made of a relatively soft material, preferably a polymer in order to avoid damaging the developing member 8. The shim is inserted in the direction of the arrow 80, preferably touching the developing member 8 at the bottom and the regulating member 10 at the same time. Then, once the release paper is pealed off the toner shield 38, it is installed where the shield face 58 touches the upper surface of the shim stock 78. In that manner the correct distance between the developing member and the toner shield is assured.

Due to the factors affecting the toner materials and formulation described in the background of the invention, i.e., high printing speed, high resolution and non-magnetic toner systems, the toner powder formulation and constituent materials have to comply in terms of flowability and chargeability. It is believed that the finer or smaller particles within the toner particle size distribution are most susceptible to scattering. It is believed that toner scatter occurs when toner particles that travel between the developing roller and the regulating member of the laser printer cartridge do not achieve sufficient charge to stick to the roller 8. This is believed to be due to their size or the speed of the revolution or both. As a result, these toner particles get detached from the developing roller 8 and accumulate in unwanted areas inside the cartridge. It is also believed that larger toner particles within the toner particle size distribution, due to their mass, tend to drift off, and as a result of the roller motion disconnect themselves from the developing roller and accumulate in other areas. The accumulation of toner in unwanted areas within the cartridge is also referred to as contamination, and can cause minor to major problems with or defects in the printed media, depending on the extent of the scattered or contaminating toner and its location. Some typical problems or defects are described hereinafter. For example there can be toner build up on regulating member. In this problem the scattered toner builds up on top of the outer surface of the regulating member. This toner buildup creates haze on the printed media due to continuous dripping of un-regulated toner on the page or other print media. A second, frequently occurring problem occurs when a local buildup of toner on the regulating member becomes heavy enough, gravity causes it to fall down onto the printed media or onto the photo-sensitive member, with the result being a print defect or problem, as illustrated in FIG. 2. Third and fourth, in the event the volume of scattered toner powder that fell over the media is big enough, it can contaminate the fuser rollers as well create permanent damage to the fuser rollers inside of the printer. A fifth typical toner scatter defect or problem relates to scattered toner that leaves the cartridge and accumulates on different printer internal components, such as for example a transfer belt in a color laser printer, on pick-up rollers and/or on laser lenses.

The spacing between the shield face, shown at 58 in FIG. 6, of the toner shield and the bottom edge of the regulating member, shown at 48 in FIG. 5, was tested. The distance between the bottom face of the toner shield and the regulating member is measured as the distance between the bottom of the edge line of the shield, shown at 68 in FIG. 6 and the center of the nip, shown at 48 in FIG. 5. It has been discovered that the lower edge of the toner shield cannot be touching the developing roller because that will prevent the toner from being transferred onto the drum. Testing to determine the largest, useable gap between the bottom surface of the toner shield and the outer surface of the developing member was determined for the cartridge of the FIG. 5 embodiment. It was discovered that the spacing between the bottom surface of the toner shield and the developing roller should 0.1 inch or less. It is believed that the gap or space dimension depends on the following factors:

The Toner Shield Edge Angle

The smaller the angle Ø between the two faces, as shown in FIG. 5, the closer the shield has to be installed to the developing roller.

The Toner Shield Material

The more negative/positive the triboelectric value of the shield, the further away from the developing roller it can be placed.

The Location of the Regulating Member Contact

The location of the toner shield depends on the shape and location of the regulating member contact. In case the regulating member contact, shown at 40 in FIG. 5, is situated at the outer face of the regulating member, shown at 10 in FIG. 4, the notch, shown at 62 in FIG. 6, has to be cut in the right position in order to sustain electrical continuity between the regulating member contact and the regulating member. The thickness and weight of the toner shield can be varied as long as it does not fall off of the developing roller and so that it is not too thick to interrupt the cartridge's printing functionality. For example, the toner shield should not be so thick that it will block the laser beam path or touch other components in the cartridge.

Although specific embodiments of the invention have been described, various modifications, alterations, alternative constructions, and equivalents are also encompassed within the scope of the invention. The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A system for preventing toner scatter in a laser printer comprising:

a laser printer toner cartridge having a hopper section adapted to contain nonmagnetic toner particles and a developing roller adapted to receive non-magnetic toner particles from the hopper section;

the hopper section having an orifice adapted to permit flow of the non-magnetic toner particles from the hopper section to the developing roller;

a toner regulating member operatively positioned to control flow of the non-magnetic toner particles through the orifice from the hopper section to the developing roller; and, a generally L-shaped shield having a first leg adhered to the toner regulating member, a second leg extending in a direction over a portion of the developing roller and an angle ϕ defined by and included between the first leg and second leg, wherein the L-shaped shield includes a material having triboelectric properties sufficient to cause the toner particles, when charged, to be repelled from the L-shaped shield;

and the shield positioned adjacent the orifice and adapted to inhibit flow of the nonmagnetic toner particles away from the developing roller.

2. The system of claim 1 wherein the angle ϕ is in the range of about 70 to 130 degrees.

3. A system for preventing toner scatter in a laser printer comprising:

a laser printer toner cartridge having a hopper section adapted to contain nonmagnetic toner particles and a developing roller adapted to receive non-magnetic toner particles from the hopper section;

the hopper section having an orifice adapted to permit flow of the non-magnetic toner particles from the hopper section to the developing roller;

a toner regulating member operatively positioned to control flow of the non-magnetic toner particles through the orifice from the hopper section to the developing roller; and, a generally L-shaped shield having a first leg adhered to the toner regulating member, a second leg extending in a direction over a portion of the developing roller and an angle ϕ defined by and included between the first leg and second leg;

and the shield positioned adjacent the orifice and adapted to inhibit flow of the nonmagnetic toner particles away from the developing roller;

the developing member includes electrically conductive material and the developing member is electrically connected to a negative electrical bias;

the toner regulating member includes electrically conductive material and the toner regulating member is electrically connected to a negative electrical bias;

and, the shield includes a negative triboelectric material that is in electrical contact with the toner regulating member.

4. A system for preventing toner scatter in a laser printer comprising:

a laser printer toner cartridge having a hopper section adapted to contain nonmagnetic toner particles and a developing roller adapted to receive non-magnetic toner particles from the hopper section;

the hopper section having an orifice adapted to permit flow of the non-magnetic toner particles from the hopper section to the developing roller;

a toner regulating member operatively positioned to control flow of the non-magnetic toner particles through the orifice from the hopper section to the developing roller; and, a generally L-shaped shield having a first leg adhered to the toner regulating member, a second leg extending in a direction over a portion of the developing roller and an angle ϕ defined by and included between the first leg and second leg; and the shield positioned adjacent the orifice and adapted to inhibit flow of the nonmagnetic toner particles away from the developing roller;

the developing member includes electrically conductive material and the developing member is electrically connected to a positive electrical bias;

the toner regulating member includes electrically conductive material and the toner regulating member is electrically connected to a positive electrical bias; and, the shield includes a positive triboelectric material that is in electrical contact with the toner regulating member.

5. The system of claim 1 wherein the first leg of the L-shaped shield is adhered to the toner regulating member by tape.

6. The system of claim 1 wherein the first leg of the L-shaped shield is adhered to the toner regulating member by tape having adhesive on two sides, one side being adhered to the shield and the other side adhered to the toner regulating member.

7. The system of claim 1 wherein the L-shaped shield is of a unitary construction.

8. A system for preventing toner scatter in a laser printer comprising:

a laser printer toner cartridge having a hopper section adapted to contain nonmagnetic toner particles and a developing roller adapted to receive non-magnetic toner particles from the hopper section;

the hopper section having an orifice adapted to permit flow of the non-magnetic toner particles from the hopper section to the developing roller;

a toner regulating member operatively positioned to control flow of the non-magnetic toner particles through the orifice from the hopper section to the developing roller; and, a generally L-shaped shield having a first leg adhered to the toner regulating member, a second leg extending in a direction over a portion of the developing roller and an angle $\phi$ defined by and included between the first leg and second leg; and the shield positioned adjacent the orifice and adapted to inhibit flow of the nonmagnetic toner particles away from the developing roller; wherein the L-shaped shield comprises:

a flat sheet made of a triboelectric material;

a first length of tape having adhesive on a first side and on a second side, the first side of which is adhered to the sheet of triboelectric material;

a rod adhered to the second side of the tape;

a second length of tape having adhesive on a first side and on a second side, the first side of which is adhered to the rod; and, the second side of the second length of tape adhered to the regulating member.

9. The system of claim 1 wherein the regulating member has a bottom edge extending along the orifice and the second leg of the L-shaped shield is spaced about 0.005 inch to about 0.500 inch from the bottom edge of the regulating member.

10. The system of claim 1 wherein the L-shaped shield includes a PVC material.

11. A method for inhibiting non-magnetic toner particles in a operating laser printer from scattering from a predetermined flow path in the laser printer to an undesirable location in the laser printer comprising:

providing a laser printer toner cartridge having a hopper section adapted to contain non-magnetic toner particles and a developing roller adapted to receive nonmagnetic toner particles from the hopper section;

providing the hopper section with an orifice adapted to permit flow of the nonmagnetic toner particles from the hopper section to the developing roller;

regulating the flow of the non-magnetic toner particles from the hopper section to the developing roller;

generating an electrostatic charge of a predetermined polarity on the non-magnetic toner particles to yield electrically charged toner particles;

providing a shield having a capability to hold an electrostatic charge on its surface, wherein the shield is made of a PVC material;

creating an electrostatic charge on the surface of the shield, the electrostatic charge on the surface of the shield being of the same polarity as the electrically charged non-magnetic toner particles;

positioning the shield in the laser printer at a location near the orifice; and, deflecting scattered charged non-magnetic toner particles from the shield toward the developing roller.

12. The method of claim 11 wherein the shield is L-shaped.

* * * * *